United States Patent [19]

Yokoyama

[11] Patent Number: 4,989,187

[45] Date of Patent: Jan. 29, 1991

[54] ACOUSTIC APPARATUS

[75] Inventor: Kenji Yokoyama, Hamamatsu, Japan

[73] Assignee: Yamaha Corporation, Hamamatsu, Japan

[21] Appl. No.: 516,059

[22] Filed: Apr. 26, 1990

Related U.S. Application Data

[63] Continuation of Ser. No. 287,381, Dec. 19, 1988, abandoned.

[30] Foreign Application Priority Data

Dec. 28, 1987 [JP] Japan ..... 62-334263

[51] Int. Cl.[5] ..... H04R 3/00

[52] U.S. Cl. ..... 367/140; 181/182; 181/184; 181/160; 381/96

[58] Field of Search ..... 367/140, 191; 381/96; 181/182, 184, 159, 160, 175, 206, 207

[56] References Cited

U.S. PATENT DOCUMENTS

| | | | |
|---|---|---|---|
| 2,887,532 | 5/1959 | Werner | 381/96 |
| 3,037,081 | 5/1962 | Carlsson | 381/90 |
| 3,864,532 | 2/1975 | Van der Plaats et al. | 340/328 |
| 4,118,600 | 10/1978 | Stahl | 179/1 |
| 4,387,270 | 6/1983 | Sakano et al. | 381/96 |
| 4,419,545 | 12/1983 | Kuindersma | 181/184 |
| 4,602,245 | 7/1986 | Yang et al. | 310/322 |
| 4,712,247 | 12/1987 | Swarte | 381/96 |
| 4,741,040 | 4/1988 | Kaizer | 381/96 |

OTHER PUBLICATIONS

"Effect of a Negative Impedance Source of Loudspeaker Performance"; Richard E. Werner, The Journal of the Acoustical Society of America; vol. 29, No. 3, Mar., 1957.

"Application of Negative Impedance Amplifiers to Loudspeaker Systems"; R. E. Werner and R. M. Carrell; Journal of the Audio Engineering Society; vol. 6, No. 4; Oct. 1958.

"A New Approach to Loudspeaker Damping"; Warner Clements; Audio Engineering; Aug. 1951.

"Loudspeakers in Vented Boxes: Part I", A. N. Thiele, Journal of Audio Engineering Society, pp. 382–392, May 1971, vol. 19, No. 5.

"Loudspeakers in Vented Boxes: Part II", A. N. Thiele, Journal of Audio Engineering Society, pp. 471–483, Jun. 1971, vol. 19, No. 6.

"Synthesis of Loudspeaker Mechanical Parameters by Electrical Means: A New Method for Controlling Low-Frequency Loudspeaker Behavior" by Karl Erik Stahl, 61st Convention of the Audio Engineering Society, New York, 1978; Revised 1981.

*Primary Examiner*—Charles T. Jordan
*Assistant Examiner*—J. Woodrow Eldred
*Attorney, Agent, or Firm*—Spensley Horn Jubas & Lubitz

[57] ABSTRACT

An acoustic apparatus comprises a resonator, a vibrator, and a vibrator drive circuit for an improved bass sound reproduction. The resonantor has a resonance radiation unit for radiating an acoustic wave by resonance, and the vibrator has a diaphragm constituting a part of the resonator and disposed in the resonator. The vibrator drive circuit for driving the vibrator has a negative impedance component in an output impedance, and a reaction from the resonator to the diagram is canceled upon driving of the resonator. Accordingly, the presence of the vibrator is invalidated as viewed from the resonator, and the vibrator and the resonator can be independently designed. As a result, the resonator can be realized in a compact size, and the resonance acoustic wave can be radiated powerfully.

18 Claims, 18 Drawing Sheets

ACOUSTIC APPARATUS

This is a continuation of copending application Ser. No. 287,381 filed on Dec. 19, 1988, now abandoned.

BACKGROUND OF THE INVENTION

1. Field of the Invention

The present invention relates to an acoustic apparatus using a resonator as an acoustic radiation member.

2. Description of the Prior Art

In an acoustic apparatus, a resonance phenomenon is utilized in a variety of forms. FIGS. 29 to 32 show typical prior art examples in which the resonance phenomenon are utilized.

In a first prior art shown in FIG. 29, a resonance cabinet 1 is partitioned into two chambers, i.e., A and B chambers, by a partition wall 2. A dynamic electro-acoustic transducer (dynamic speaker) 3 serving as a vibrator is attached to a hole of the partition wall 2. Opening ducts 4*a* and 4*b* are respectively provided to the A and B chambers, and resonance acoustic waves are externally radiated from these ducts, as indicated by arrows. The A and B chambers respectively have resonance frequencies $f_{oa}$ (Hz) and $f_{ob}$ (Hz) determined by the volumes of cavities (i.e. the volumes of chambers A and B), the dimensions of the opening ducts 4*a* and 4*b*, and the like. Therefore, when the speaker 3 is driven by an amplifier (not shown), a resonance phenomenon occurs by the vibration of a diaphragm, and an output energy at that time has maximum values near the above-mentioned resonance frequencies. As a result, the resonance acoustic waves having sound pressure-frequency characteristics illustrated in FIG. 30 can be obtained.

In a second prior art shown in FIG. 31, a dynamic electro-acoustic transducer (speaker) 6 serving as a vibrator is attached to a resonance chamber 5' defined by a cabinet 5, and an opening 7 for externally radiating resonance acoustic wave is formed in the chamber 5'. Another dynamic electro-acoustic transducer (speaker) 8 is separately provided to the cabinet 5, so that an acoustic wave is directly radiated therefrom In this acoustic apparatus, when the speaker 6 is driven by an amplifier (not shown), a resonance phenomenon occurs in the resonance chamber 5' due to the vibration of a diaphragm of the speaker 6. Therefore, acoustic reproduction illustrated in FIG. 32 is made from the opening 7 to have a peak sound pressure near a resonance frequency $f_o$ inherent to the resonance chamber 5'.

However, according to conventional acoustic apparatuses, the vibrator undesirably causes a decrease in resonance Q value of the resonator serving as an acoustic radiation member. This is because the speaker as the vibrator has an inherent internal impedance $Z_v$, and the internal impedance damps the resonance of the resonator. In this manner, if the resonance Q value is low, radiation power of the resonance acoustic wave is inevitably low and the presence of the resonator in the acoustic apparatus is meaningless.

If the resonance frequency is decreased while rendering the resonator compact, the opening duct must be elongated. Accordngly, the acoustic resistance (mechanical resistance) of the-opening duct is inevitably increased, and the resonance Q value is decreased further For this reason, the acoustic radiation power is further decreased due to a decrease in resonance Q value, and the acoustic apparatus is not suitable for a practical use.

As a result, neither of the conventional apparatuses shown in FIGS. 29 and 31 have sufficient acoustic radiation power. If a certain level of power is to be maintained, the cabinet becomes extremely large.

SUMMARY OF THE INVENTION

It is therefore an object of the present invention to provide an acoustic apparatus which can realize sufficient acoustic radiation power and can be rendered compact.

An acoustic apparatus according to the present invention comprises: a resonator having a resonance radiation unit for radiating an acoustic wave by resonance; a vibrator having a diaphragm constituting a part of the resonator and disposed in the resonator; and a vibrator drive means for driving the vibrator so that a reaction (counterreaction force) of the resonator upon the diaphragm is canceled upon driving of the resonator.

According to the present invention, since the vibrator is driven by the vibrator drive means so as to cancel a reaction of the resonator, a diaphragm equivalently becomes an wall of the resonator, and the presence of the vibrator is invalidated when viewed from the resonator. Therefore, the internal impedance inherent to the vibrator does not cause a decrease in resonance Q value of the resonator. For this reason, the resonance Q value of the resonator can be extremely high. When the resonator is rendered compact and the resonance frequency is decreased, in the prior art devices, the acoustic resistance of the resonator is increased. However, according to the present invention, even in a case wherein the resonance Q value becomes very small in a conventional drive method, the resonance Q value is not decreased by the presence of the vibrator. As a result, the resonance Q value can be kept at a sufficiently high value, and sufficient acoustic radiation power of the resonator can be maintained.

As described above, improvement of radiation power of a resonance acoustic wave and a compact resonator can be simultaneously realized

DETAILED DESCRIPTION OF THE PREFERRED EMBODIMENTS

Figure 1A:
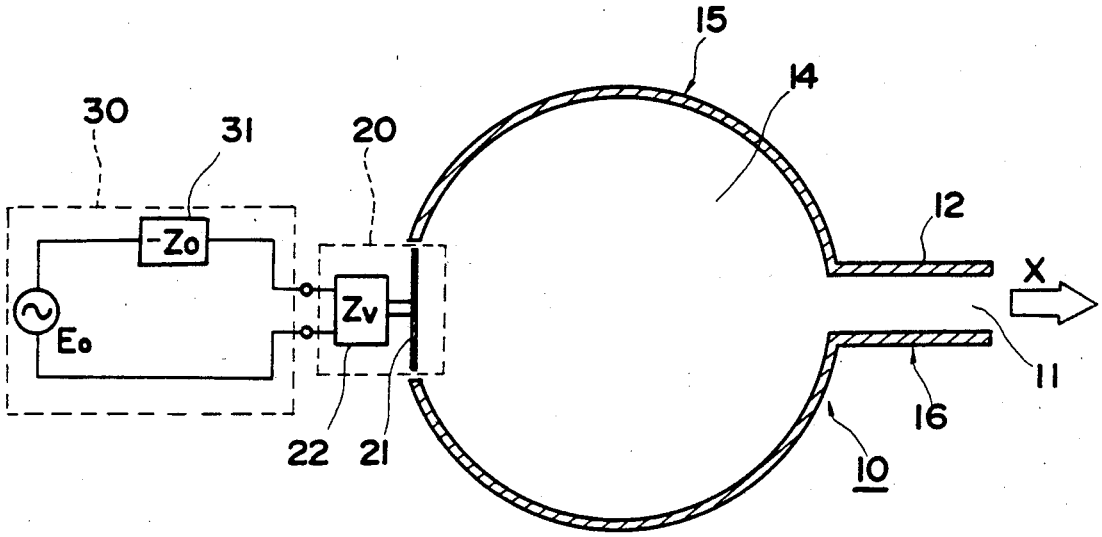
FIGS. 1A and 1B are diagrams for explaining a basic arrangement of an embodiment of the present invention.

A preferred embodiment of the present invention will be described hereinafter with reference to FIGS. 1 to 28. The same reference numerals in the drawings denote the same parts to avoid repetitive descriptions.

Figure 1B:
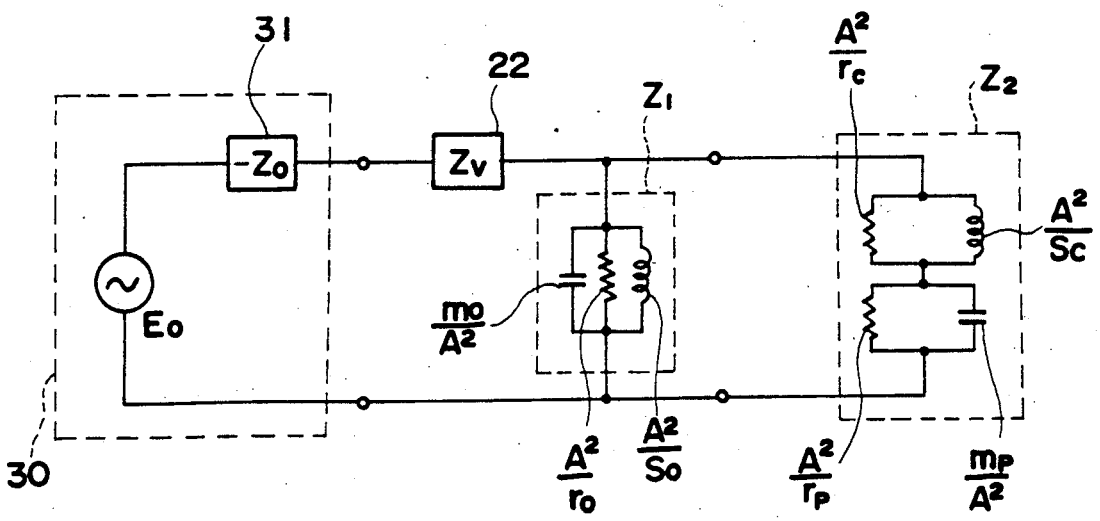

FIGS. 1A and 1B show a basic arrangement of an embodiment of the present invention. As shown in FIG. 1A in this embodiment, a Helmholtz's resonator 10 having an opening port 11 and a neck 12 serving as a resonance radiation unit is used In the Helmholtz's resonator 10, a resonance phenomenon of air is caused by a closed cavity 14 formed in a body portion 15 and a short tube or duct 16 constituted by the opening port 11 and the neck 12. The resonance frequency $f_{op}$ is given by:

$$f_{op}=c(S/lV)^{\frac{1}{2}}/2\pi \quad (1)$$

where c: velocity of sound

S: sectional area of duct 16 l: length of neck 12 of duct 16

V: volume of cavity 14

In the acoustic apparatus of this embodiment, a vibrator 20 constituted by a diaphragm 21 and a transducer 22 is attached to the body portion 15 of the resonator 10. The transducer 22 is connected to a vibrator driver 30, which comprises a negative impedance generator 31 for equivalently generating a negative impedance component ($-Z_0$) in the output impedance.

FIG. 1B shows an arrangement of an electric equivalent circuit of the acoustic apparatus shown in FIG. 1A. In FIG. 1B, a parallel resonance circuit $Z_1$ corresponds to an equivalent motional impedance of the vibrator 20, $r_o$ indicates an equivalent resistance of a vibration system of the vibrator 20; $S_o$, an equivalent stiffness of the vibration system; and $m_o$, an equivalent mass of the vibration system. A series resonance circuit $Z_2$ corresponds to an equivalent motional impedance of the Helmholtz's resonator 10, $r_c$ indicates an equivalent resistance of the cavity 14; $S_c$, an equivalent stiffness of the cavity 14; $r_p$, an equivalent resistance of the duct 16; and $m_p$, an equivalent mass of the duct 16 In FIG. 1B, reference symbol A denotes a force coefficient. For example, if the vibrator is a dynamic electro-acoustic transducer (speaker), $A=Bl_v$ where B is the magnetic flux density in the magnetic gap, and $l_v$ is the length of the voice coil conductor. Furthermore, in FIG. 1B, $Z_v$ indicates an inherent internal impedance of the transducer 22. For example, if the vibrator 20 is a dynamic speaker, the impedance $Z_v$ mainly serves as a DC resistance of the voice coil, and includes a small inductance.

The operation of the acoustic apparatus with the arrangement shown in FIG. 1A will be briefly described below.

When a drive signal is supplied from the vibrator driver 30 having a negative impedance drive function to the transducer 22 of the vibrator 20, the transducer 22 electric-mechanical converts the drive signal so as to reciprocally drive the diaphragm 21 forward and backward (in the right and left directions in FIG. 1A. The diaphragm 21 mechanical-acoustic converts this reciprocal motion. Since the vibrator driver 30 has the negative impedance drive function, the internal impedance inherent to the transducer 22 is essentially decreased (ideally invalidated). Therefore, the transducer 22 drives the diaphragm 21 faithfully in response to the drive signal from the vibrator driver 30, and supplies a drive energy to the Helmholtz's resonator 10.

In this case, the front surface side (the right surface side in FIG. 1A) of the diaphragm 21 receives reaction of air in the cavity 14 of the Helmholtz's resonator 10, and the vibrator driver 30 drives the vibrator 20 so as to cancel the reaction. This is because the internal impedance $Z_v$ inherent to the transducer 22 of the vibrator 20 is equivalently invalidated. Hence the diaphragm 21 becomes an equivalent wall of the Helmholtz's resonator 10, and the resonance Q value ideally becomes infinite. For this reason, air in the Helmholtz's resonator 10 is resonated, so that, as indicated by an arrow X in FIG. 1A, an acoustic wave having a sufficient sound pressure is radiated from the resonance radiation unit.

Figure 2:
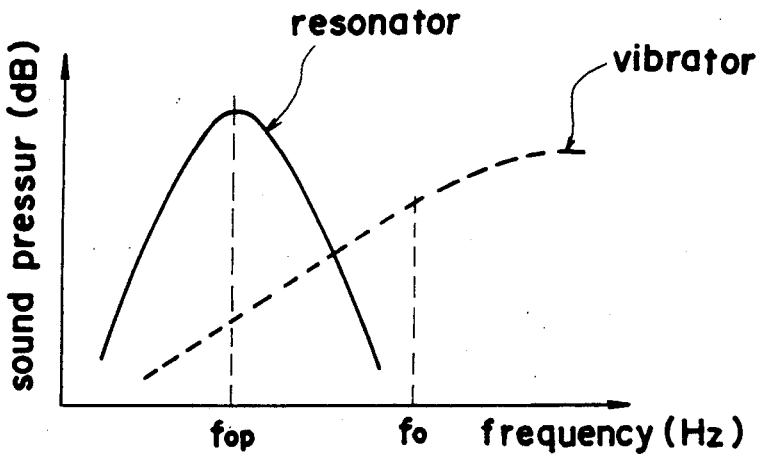
FIG. 2 is a graph showing sound pressure-frequency characteristics of the embodiment shown in FIGS. 1A and 1B.

By adjusting an air equivalent mass in the duct 16 of the Helmholtz's resonator 10, the resonance frequency $f_{op}$ is set in a predetermined frequency range, and by adjusting the equivalent resistance of the duct 16, the resonance Q value is set to be an appropriate level, so that a sound pressure of an appropriate level can be obtained from the opening port 11, By these adjustments, sound pressure-frequency characteristics shown in, e.g., FIG. 2 can be obtained. Note that a dotted characteristic curve in FIG. 2 represents an example of frequency characteristics of the vibrator 20 itself.

This will be explained with reference to the equivalent circuits shown in FIGS. 3 and 4.

Figure 3:
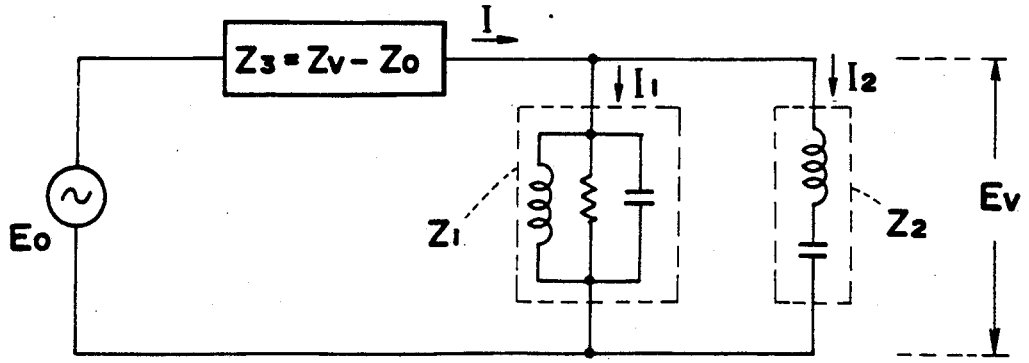
FIG. 3 is a circuit diagram showing an electric equivalent circuit of FIG. 1A.

FIG. 3 shows a simplified electric equivalent circuit of FIG. 1B. In other words FIG. 3 is an equivalent circuit diagram regardless of the equivalent resistances $r_c$ and $r_p$ since the equivalent resistance $r_c$ of the cavity 14 and the equivalent resistance $r_p$ of the duct 16 are sufficiently small, and hence, their reciprocal components are extremely large In FIG. 3, if I indicates a current flowing through the circuit, $I_1$ and $I_2$ indicate currents flowing through the parallel and series resonance circuits $Z_1$ and $Z_2$, respectively, and $Z_3=Z_v-Z_o$, equations (2) to (4) below are established:

$$E_v=E_0\cdot\{Z_1\cdot Z_2/(Z_1+Z_2)\}/[\{Z_1\cdot Z_2/(Z_1+Z_2)\}+Z_3] \quad (2)$$

$$I_1=E_0\cdot\{Z_2/(Z_1+Z_2)\}/[\{Z_1\cdot Z_2/(Z_1+Z_2)\}+Z_3] \quad (3)$$

$$I_2=E_0\cdot\{Z_1/(Z_1+Z_2)\}/[\{Z_1\cdot Z_2/(Z_1+Z_2)\}+Z_3] \quad (4)$$

In order to simplify equations (3) and (4) if $Z_4=Z_1\cdot Z_2/(Z_1+Z_2)$, equation (3) is rewritten as:

$$I_1=E_0/\{Z_1(1=Z_3/Z_4)\} \quad (5)$$

and, equation (4) is rewritten as:

$$I_2=E_0/\{Z_2(1+Z_3/Z_4)\} \quad (6)$$

From equations (5) and (6), the following two points can be understood. First, if the $Z_3$ value approaches zero, the parallel resonance circuit $Z_1$ of the vibrator and the series resonance circuit $Z_2$ of the resonator approach a state wherein they are short-circuited in an AC manner, accordingly. Second, the series resonance circuit $Z_2$ is influenced by the parallel resonance circuit $Z_1$ through $Z_3=Z_v-Z_0$, and the series resonance circuit $Z_2$ enhances its independency with respect to the parallel resonance circuit $Z_1$ as the $Z_3$ value approaches zero.

Assuming an ideal state wherein $Z_3=Z_v-Z_0=0$, equations (5) and (6) are ideally given by:

$$I_1=E_0/Z_1 \quad (7)$$

$$I_2=E_0/Z_2 \quad (b\ 8)$$

Both the series resonance circuit $Z_2$ and the parallel resonance circuit $Z_1$ are short-circuited with a zero impedance in an AC manner, and the series resonance circuit $Z_2$ can be regarded as a resonance system perfectly independently of the parallel resonance circuit $Z_1$.

Figure 4:
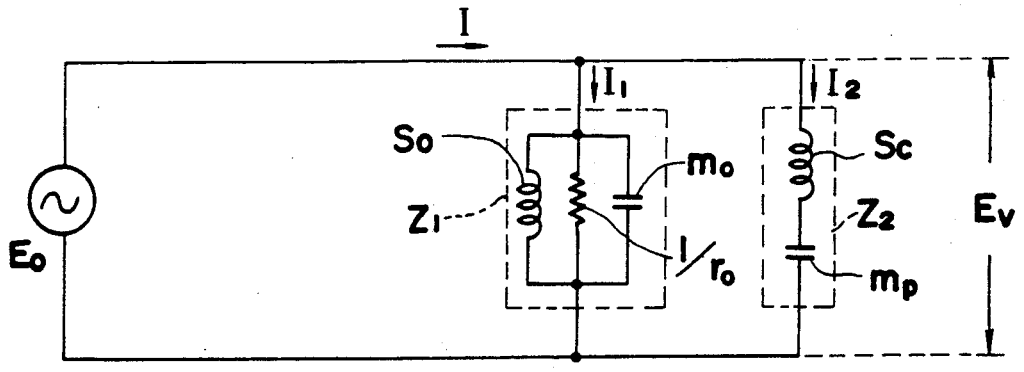
FIG. 4 is a circuit diagram showing an equivalent circuit when $Z_3=0$ in the circuit shown in FIG. 3.

FIG. 4 shows an equivalent circuit of FIG. 3 when $Z_0=Z_v$, i.e., when $Z_3=Z_v-Z_0=0$. Strictly examining a resonance system of the vibrator 20 as a condition for examining the Helmholtz's resonance system constituted by the Helmholtz's resonator 10, the two ends of the parallel resonance circuit $Z_1$ formed by the equivalent motional impedance are short-circuited with a zero impedance in an AC manner. Therefore the parallel resonance circuit $Z_1$ is essentially no longer a resonance circuit. More specifically, the transducer 22 of the vibrator 20 linearly responds to a drive signal input in real time, and faithfully electric-mechanical converts an electric signal (drive signal) $E_o$ without a transient response, thus displacing the diaphragm 21. In the vibrator 20, the concept of a minimum resonance frequency $f_o$ which is obtained when the vibrator is simply mounted on the Helmholtz's resonator 10 is not applicable. This is because the two ends of the parallel resonance circuit $Z_1$ of the vibrator 20 are short-circuited with a zero impedance in an AC manner (In the following description, "a value corresponding to the minimum resonance frequency $f_o$ of the vibrator 20" refers to the above-mentioned concept which is not essentially applicable any longer ) The vibrator 20 and the Helmholtz's resonator 10 are independent of each other, and the vibrator 20 and the duct 16 are also independent of each other. For this reason, the vibrator 20 functions independently of the volume of the cavity 14 of the Helmholtz's resonator 10, the inner diameter of the opening port 11, the length of the neck 12, and the like (i.e., independently of the equivalent motional impedance $Z_2$ of the Helmholtz's resonance system).

The parallel resonance circuit $Z_1$ is present independently of the series resonance circuit $Z_2$. Therefore, if the body portion 15 of the Helmholtz's resonator 10 is designed to have a small cavity volume in order to reduce the size of the system, or when the duct 16 is designed to be elongated in order to reduce the Q value of the Helmholtz's resonance system, as will be described later, the design of the parallel resonance circuit $Z_1$, i.e., the unit vibration system, does not influence the Helmholtz's resonator at all. For this reason, easy designing free from the mutual dependency condition is allowed.

From another point of view since the unit vibration system $Z_1$ is not effectively a resonance system, if the drive signal input is zero volt the diaphragm 21 becomes a part of the wall of the Helmholtz's resonator 10.

Figure 29:
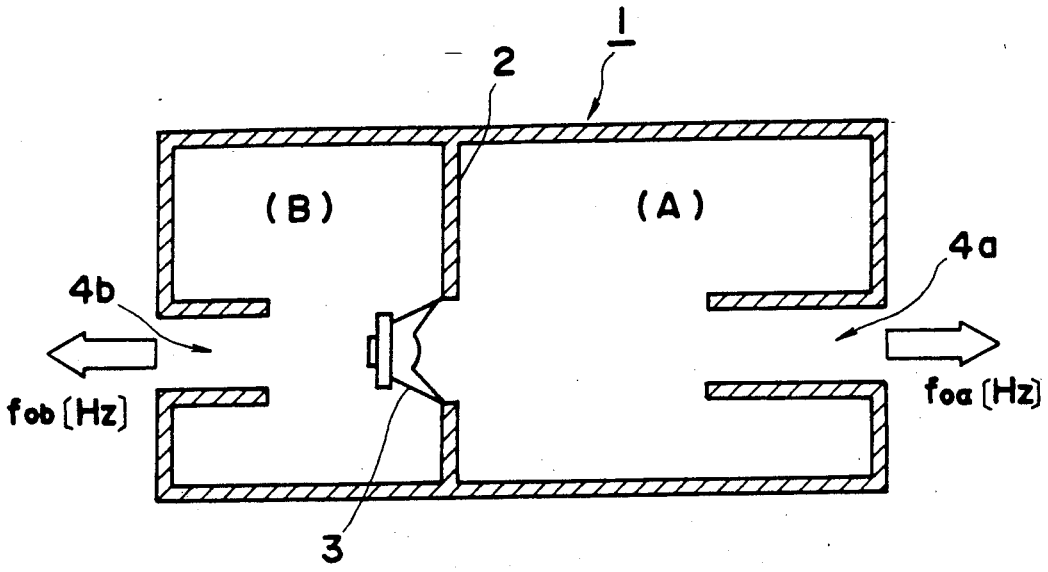
FIG. 29 is a sectional view of an acoustic apparatus of a first prior art.
Figure 30:
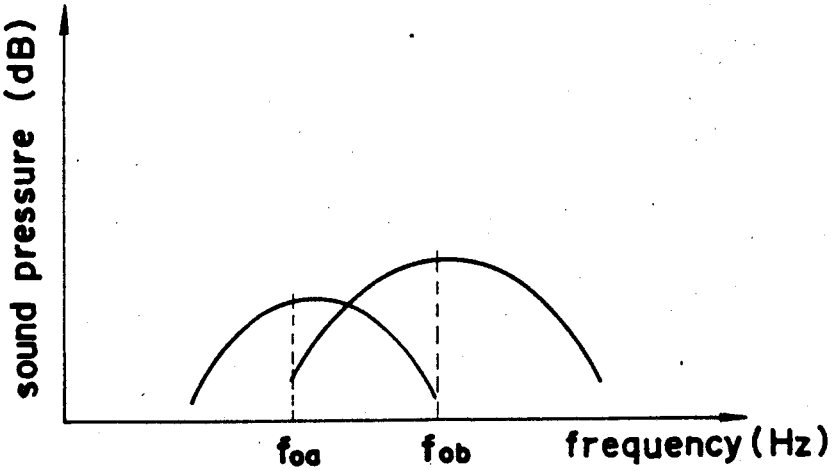
FIG. 30 is a graph for explaining sound pressure-frequency characteristics of the first prior art.
Figure 31:
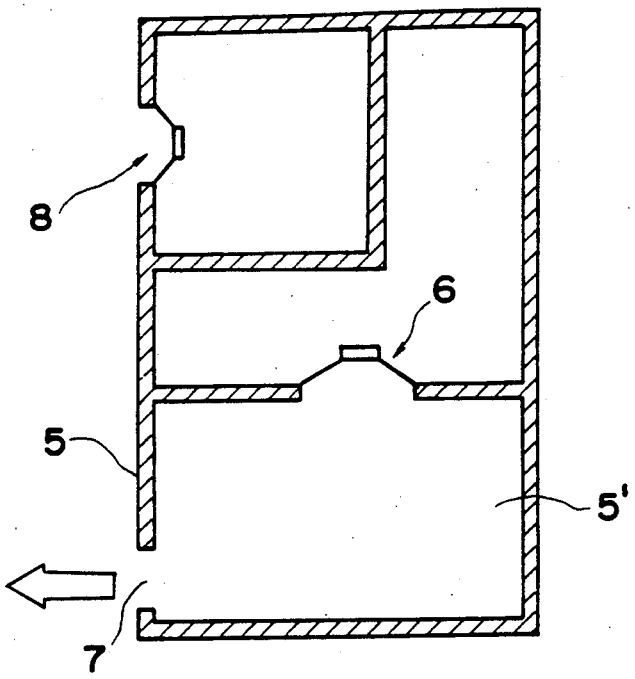
FIG. 31 is a sectional view showing an acoustic apparatus of a second prior art.
Figure 32:
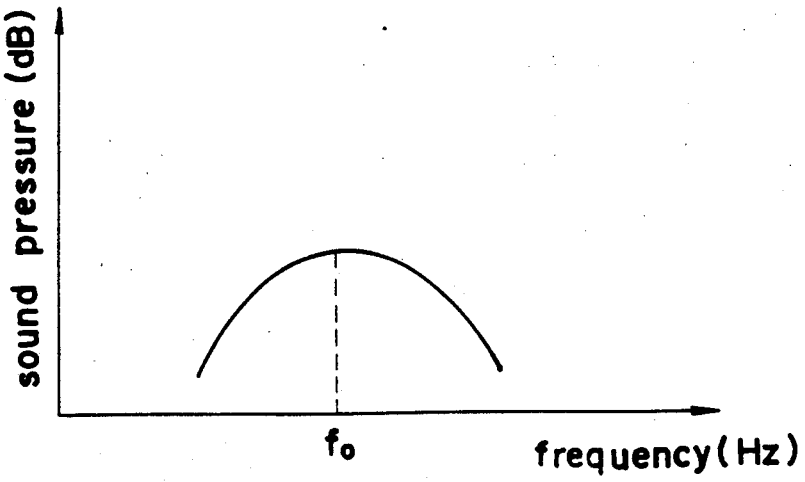
FIG. 32 is a graph for explaining sound pressure-frequency characteristics of the second prior art.

From still another point of view in the acoustic apparatus of the present invention, the Helmholtz's resonance system is the only resonance system. (In the conventional apparatuses shown in FIGS. 29 and 31, the vibrator itself forms a resonance system in addition to the Helmholtz's resonance system Therefore, a plurality of resonance systems are present.)

The resonance system (Helmholtz's resonance system) constituted by the cavity 14, and the duct 16 will be examined in detail below with reference to FIG. 4.

Driving of the Helmholtz's resonator 10 will be explained below From equations (7) and (8) described above, the current I flowing through the transducer 22 of the vibrator 20 is:

$$\begin{aligned} I &= I_1 + I_2 \\ &= (1/Z_1 + 1/Z_2)E_0 \end{aligned} \quad (9)$$

However, $Z_2$ value is approximately 0 near the resonance frequency $f_{op}$ of the resonator in a state wherein the resonator causes Helmholtz's resonance (practically, however, $Z_2$ is damped by a resistance component). Meanwhile, since the value corresponding to the minimum resonance frequency $f_o$ of the vibrator 20 is higher than the resonance frequency $f_{op}$ of the Helmholtz's resonator 10, the $Z_1$ value is sufficiently large near the resonance frequency $f_{op}$. For this reason, equation (9) can be rewritten as:

$$I=I_1+I_2\approx I_2$$

Almost all the current flowing through the transducer 22 of the vibrator 20 contributes to driving of the Helmholtz's resonator 10. Since $Z_2$ value is approximately 0, the Helmholtz's resonator 10 is driven by a large current and a small-amplitude voltage. Therefore, the transducer 22 connected in parallel therewith is also driven by the small-amplitude voltage, and hence, the diaphragm 21 performs a small-amplitude operation. In this case, since the diaphragm 21 performs the small-amplitude operation, a nonlinear distortion which usually occurs in a large-amplitude operation of a dynamic cone speaker can be effectively eliminated in, particularly, a super-bass range.

The resonance frequency of the Helmholtz's resonator 10 will be described below. This resonance frequency is that of the series resonance circuit $Z_2$. As can be seen from equation (1), by adjusting the sectional area S of the duct 16 and the length ( of its neck 12, the resonance frequency can be arbitrarily set independently of the volume V of the cavity 14 of the resonator 10. (Of course, the resonance frequency can also be adjusted by controlling the volume V.)

The resonance Q value of the series resonance circuit $Z_2$ formed by the Helmholtz's resonator 10 will be described below. The two ends of the series resonance circuit $Z_2$ are short-circuited with a zero impedance in an AC manner. Therefore, the Q value given by the relation of:

(load resistance)/(resonance impedance)

becomes infinite in the equivalent circuit shown in FIG. 4. In this case, the resonance Q value is accurately calculated based on the equivalent circuit shown in FIG. 1B:

$$Q=(m_pS_c)^{178}/(r_c+r_p)$$

Normally, $r_c$ and $r_p$ are very small, and if they are ignored as zero, the same result is also obtained.

More specifically, according to the present invention, the resonance Q value of the resonator 10 is greatly increased as compared to the conventional apparatus, and this can also be regarded as that the margin of the acoustic radiation power of the resonator 10 is extremely increased.

Generally speaking, control for decreasing the resonance Q value of the Helmholtz's resonator 10 or the like as needed can be easily achieved For example when the Helmholtz's resonator 10 is rendered compact the resonance frequency $f_{op}$ of the resonance system can be decreased by decreasing the sectional area S of the opening port 11 or increasing the length l of the neck 12 in equation (1) described above:

$$f_{op}=c(S/lV)^{\frac{1}{2}}/2\pi$$

This means that in the acoustic apparatus of the present invention, setting for making the system compact and achieving super-bass reproduction becomes a factor for appropriately decreasing the Q value. More specifically, elongation of the duct 16 amounts to an increase in mechanical resistance (acoustic resistance) due to an air friction. Hence, in the equivalent circuit shown in FIG. 1B, since $A^2/r_p$ is decreased, the Q value of the series resonance circuit $Z_2$ on the side of the Helmholtz's resonator 10 is decreased, and as a result, the damping characteristics can be appropriately improved. This point forms a remarkable contrast with the conventional apparatuses shown in FIGS. 29 and 31 wherein when the apparatus is rendered compact, the Q value of the resonance system is extremely reduced and at last, acoustic radiation power is lost.

In addition, $A_2/r_c$ is decreased by inserting a sound absorbing material in the cavity 14 of the Helmholtz's resonator 10 so as to control the Q value to be a desired value. In any case, even if the Q value of the Helmholtz's resonance system is controlled under the condition of making the resonator (or cabinet) compact, the unit vibration system is not influenced.

In this manner, the Helmholtz's resonator 10, the resonance frequency and resonance Q value of which are solely set should be regarded as a virtual speaker independently of the unit vibration system. Although the virtual speaker can be realized with a small diameter corresponding to the diameter of the opening port, it corresponds to a very large-diameter speaker as an actual speaker in view of its bass reproduction power, and can provide remarkable effects for dimensional efficiency or sound source concentration In this sense, cost efficiency is very large The virtual speaker includes not an actual diaphragm but a diaphragm constituted by only air, and can be an ideal one.

As can be seen from the above description, according to the present invention, the resonance Q value of the resonator is extremely large (if approximate to an ideal state, $Q\approx\infty$). Although this resonator is driven by the displacement of the diaphragm in practice, the resonator can be assumed to receive a drive energy from a drive source in parallel with and independently of the vibrator in view of the equivalent circuit. Therefore, designing of the resonator can be made regardless of mutual dependency conditions between the resonator and the vibrator. In addition, since the volume of the cavity of the resonator does not influence the vibrator at all, the resonance frequency of the resonator is independently set without considering its volume, so that super-bass reproduction having a sufficient sound pressure can be achieved by a compact apparatus. For example, the sound pressure-frequency characteristics shown in FIG. 2 can be readily realized by a compact apparatus (cabinet).

In the description of the basic arrangement, the ideal state is assumed to be:

$$Z_3=Z_v-Z_0=0$$

Essentially, the effect of the present invention can be sufficiently obtained if:

$$0\leqq Z_3<Z_v$$

More specifically, if the vibrator is driven to cancel a reaction applied of the resonator as much as possible upon driving of the resonator, an effect can be obtained accordingly. This is because a degree that the diaphragm of the unit vibration system becomes the wall of the Helmholtz's resonator is correlated with a degree that the diaphragm is passively driven by the reaction from the resonator, and a reaction canceling effect is enhanced as the $Z_3$ value decreases. Therefore, in, e.g., a dynamic speaker, if an internal resistance of a voice coil is 8Ω, an equivalent negative resistance of −4Ωis generated to apparently reduce the resistance to 4Ω, so that satisfactory bass reproduction can be realized from the Helmholtz's resonator.

It is not preferable that a negative impedance is set too large and the value of $Z_3=Z_v-Z_0$ becomes negative. This is because if $Z_3$ becomes negative, the circuit as a whole including a load has negative resistance characteristics, and causes oscillation. Therefore, if the value of the internal impedance $Z_v$ is changed due to heat during operation, the value of the negative impedance must be set with a certain margin or the value of the negative impedance must be changed (temperature-compensated) in accordance with a change in temperature.

The resonance Q value of the unit vibration system will be additionally explained below. When this vibration system is driven to cancel a reaction of the resonator, the internal impedance $Z_v$ inherent to this vibration system is essentially invalidated In this case, in the parallel resonance system, the Q value given by the following relation becomes zero for the parallel resonance circuit $Z_1$:

(load resistance)/(resonance impedance)

Q=0 in the unit vibration system corresponds to the fact that the vibrator 20 equivalently forming the parallel resonance circuit $Z_1$ becomes a speaker which is driven by current source given by $E_v/(A^2/r_o)$ which is determined by the input voltage $E_v$ and a resistance $A^2/r_o$ of the parallel resonance circuit $Z_1$. A current drive region in an electrical sense is equivalent to a velocity drive region in a mechanical sense, and frequency characteristics of an acoustic wave near the value corresponding to the minimum resonance frequency $f_o$ of this speaker are 6 dB/oct. In contrast to this, characteristics in a normal voltage drive state are 12 dB/oct.

From another point of view, the diaphragm 21 can be in a perfectly damped state. More specifically, for a reaction caused by driving the diaphragm 21, control is made to overcome the reaction by increasing/decreasing the drive current. Therefore, for example, when an external force is applied to the diaphragm 21, a counter drive force acts at that moment until a state balanced with the external force is established (active servo)

Various embodiments which can be applied to the basic arrangement described above with reference to FIGS. 1 to 4 will be explained below The resonator is not limited to one shown in FIG. 1A. For example, the shape of the cavity or body portion is not limited to a sphere but can be a rectangular prism or cube. The volume of the resonator is not particularly limited, and can be designed independently of the unit vibration system. For this reason, the resonator can be rendered compact, resulting in a compact cabinet. The sectional shapes of the opening port and the neck constituting the resonance radiation unit are not particularly limited. For example, a sound path may extend externally, as shown in FIG. 1A or may be housed in the cavity. The neck 12 may be omitted, so that an opening is merely present. In addition, a plurality of openings may be formed. Furthermore, the resonance frequency $f_{op}$ can be appropriately set considering the correlation between the sectional area of the opening port and the length of the neck. Since the sectional area of the opening port can be appropriately set considering the correlation with the length of the neck, the opening of the port is reduced, so that a virtual bass-range speaker (woofer) can have a small diameter. Thus, a sound source can be concentrated to improve a sense of localization.

Various types of vibrator (electro-acoustic transducer) such as dynamic type, electromagnetic type, piezoelectric type, and electrostatic type vibrators can be adopted, as shown in FIGS. 5 to 12.

Figure 5:
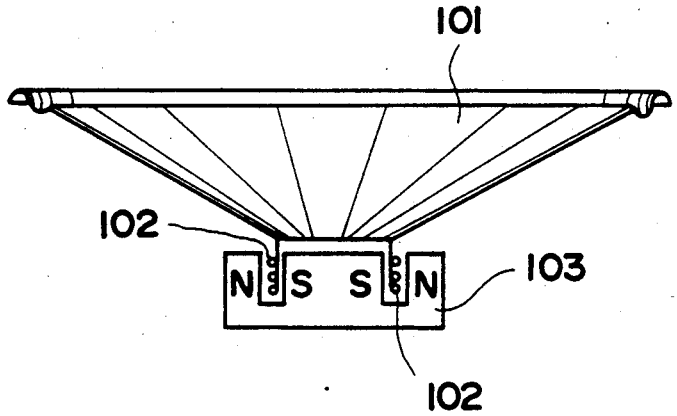
FIGS. 5 to 9 are views for explaining some dynamic speakers.
Figure 6:
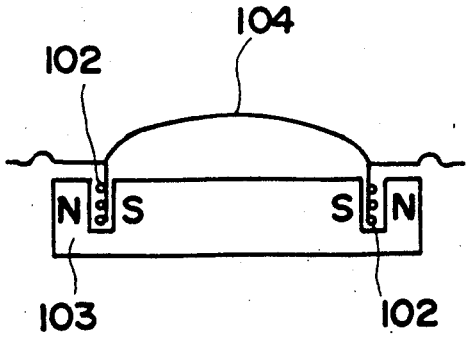

Diaphragms of dynamic speakers include cone, dome, ribbon, entire-surface drive, and hile driver types, as shown in FIGS. 5 to 9. A cone type dynamic speaker has a conical cone 101 as a diaphragm, as shown in FIG. 5, and a voice coil 102 is fixed near the top of the cone 101. The voice coil 102 is inserted in a magnetic gap formed in a magnetic circuit 103. In the cone type dynamic speaker, a non-motional impedance component appears mainly as a resistance. A dome type dynamic speaker shown in FIG. 6 is basically the same as the cone type dynamic speaker shown in FIG. 5, except that the diaphragm comprises a dome 104.

Figure 7:
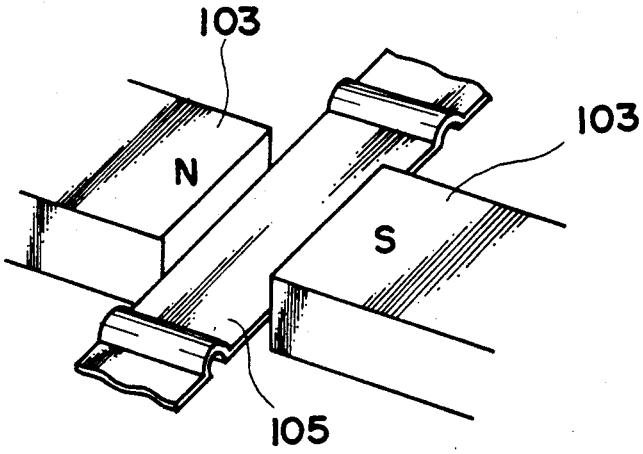

A ribbon type dynamic speaker is arranged such that a ribbon diaphragm 105 is disposed in a magnetic gap, as shown in FIG. 7. In a speaker of this type, a drive current is flowed in the longitudinal direction of the ribbon diaphragm 105, so that the diaphragm 105 is vibrated forward and backward (upward and downward in FIG. 7), thereby generating an acoustic wave. Therefore, the ribbon diaphragm 105 serves as both the voice coil and the diaphragm. In this speaker, the non-motional impedance component appears mainly as a resistance.

Figure 8:
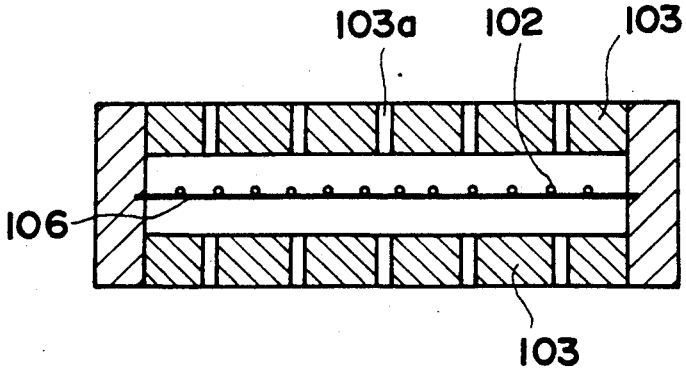

An entire-surface drive type dynamic speaker is arranged such that parallel magnetic plates 103 each having openings **103*a* for radiating acoustic waves are disposed, and a diaphragm 106 having a voice coil 102 is disposed therebetween, as shown in FIG. 8. Each magnetic plate 103 is magnetized so that its lines of magnetic force are parallel to the diaphragm 106. The voice coil 102 is fixed on the diaphragm 106** in a spiral shape.

Figure 9:
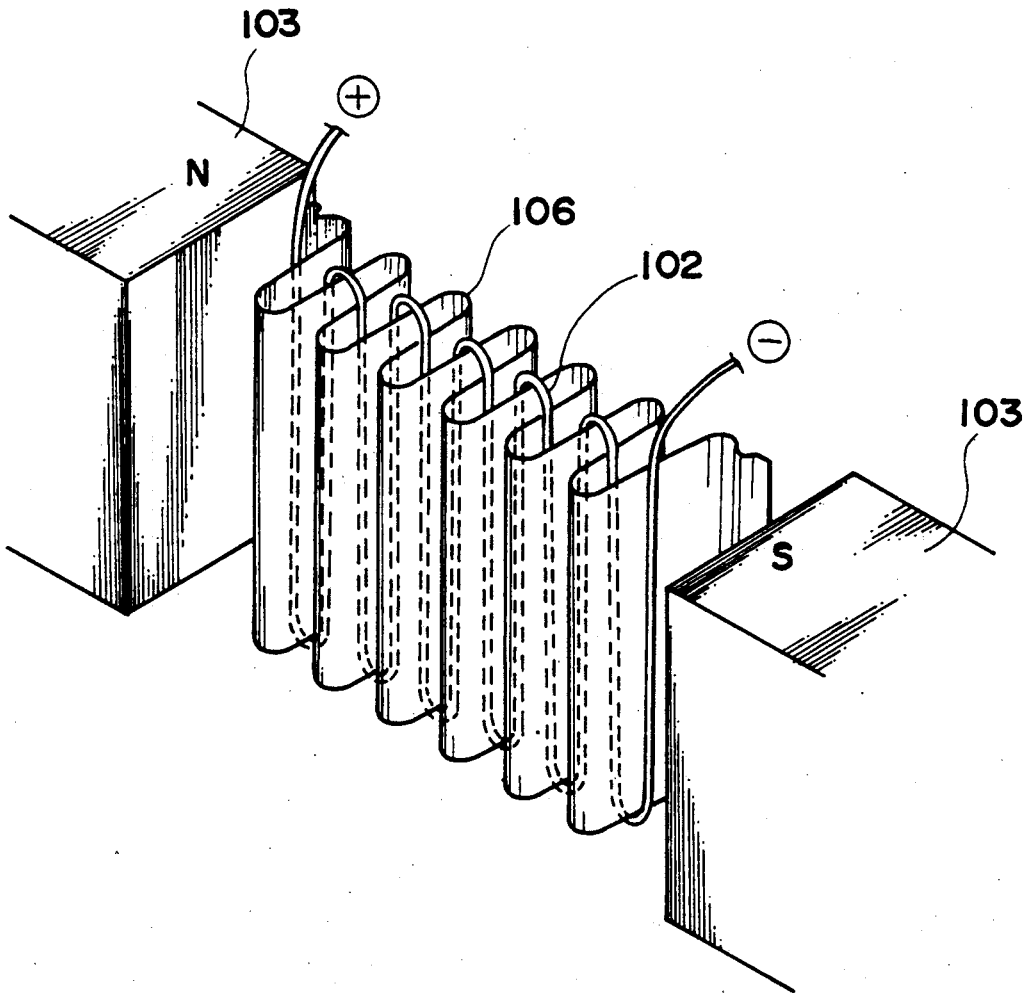

In a hile driver type dynamic speaker shown in FIG. 9, the voice coil 102 is also disposed on the diaphragm 106 More specifically, the diaphragm 106 is arranged in a bellows-like shape, and the voice coil 102 is fixed thereto in a zig-zag manner. With this speaker, the bellows of the diaphragm 106 is alternately expanded/contracted, thus radiating an acoustic wave. In this speaker, a non-motional impedance component appears mainly as a resistance.

Figure 10:
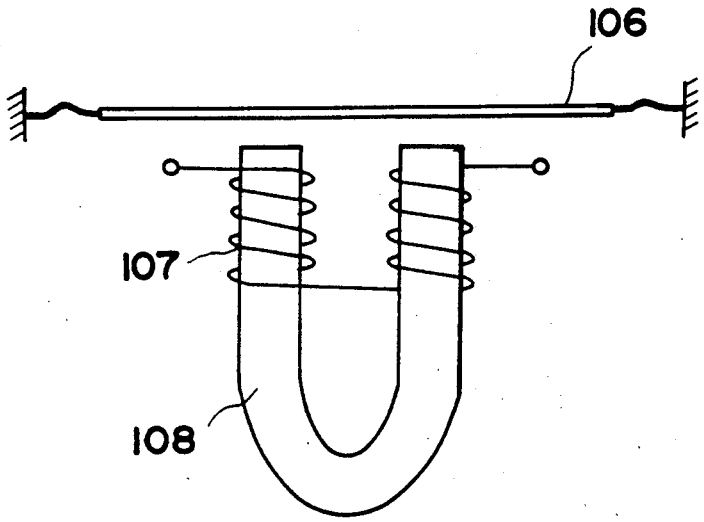
FIG. 10 is a sectional view for explaining an electromagnetic speaker.

An electromagnetic speaker as shown in FIG. 10 is known. As shown in FIG. 10, a diaphragm 106 arranged in a vibration free state includes a magnetic member, and an iron core 108 around which a coil 107 is wound is arranged near the diaphragm 106. In this speaker, a drive current is flowed through the coil 107, so that the diaphragm 106 is vibrated by the lines of magnetic force from the iron core 108, thus radiating an acoustic wave in the vertical direction in FIG. 10 In a speaker of this type, the non-motional impedance component appears mainly as a resistance.

Figure 11:
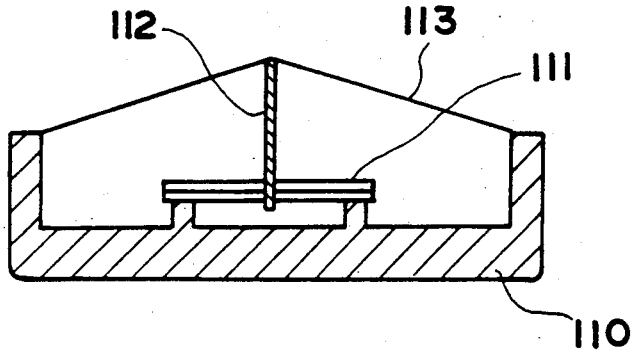
FIG. 11 is a sectional view for explaining a piezoelectric speaker.

A piezoelectric speaker as shown in FIG. 11 is known. As shown in FIG. 11, two ends of a bimorph 111 which is vibrated by an electrostrictive effect are fixed to a support member 110, and a vibration rod 112 projects upright from the central portion of bimorph 111 The distal end of the vibration rod 112 abuts against substantially the central portion of a diaphragm 113 fixed to the support member 110. In this speaker, the bimorph 111 is bent by the electrostrictive effect, so that its central portion is vibrated vertically. The vibration of the bimorph 111 is transmitted to the diaphragm 113 through the vibration rod 112. Therefore, the diaphragm 113 is vibrated in accordance with a drive current so as to radiate an acoustic wave. Note that in this speaker, the non-motional impedance component appears mainly as an electrostatic capacitance, or the like.

Figure 12A:
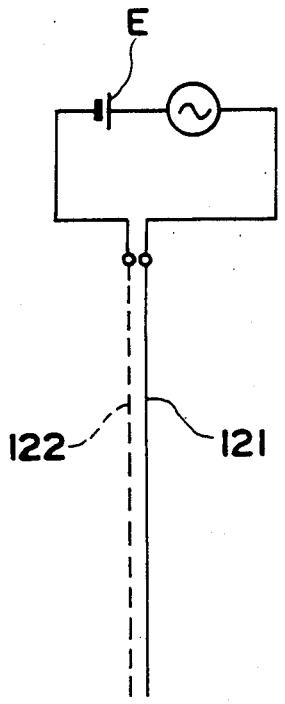
FIGS. 12A and 12B are circuit diagrams for explaining an electrostatic speaker.
Figure 12B:
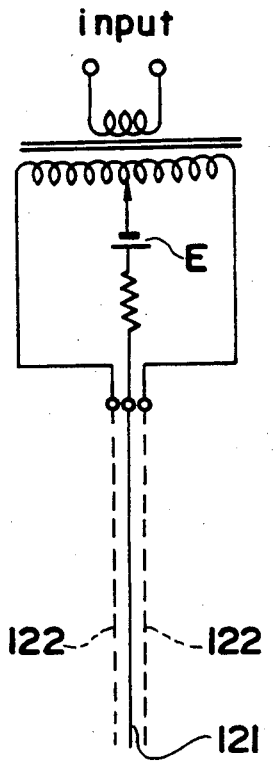

Electrostatic speakers as shown in FIGS. 12A and 12B are known. The speaker shown in FIG. 12A is called a single type capacitor type speaker, and the speaker shown in FIG. 12B is called a push-pull type capacitor type speaker. In FIG. 12A, a diaphragm 121 is juxtaposed near a mesh electrode 122, and receives an input signal superposed on a bias voltage E. Therefore, the diaphragm 121 is vibrated by an electrostatic effect, thus radiating an acoustic wave In this case, since a reaction of a displacement current occurs due to vibration of the diaphragm 121, a negative impedance (capacitance) can be equivalently generated by utilizing this reaction current. In FIG. 12B, the diaphragm 121 is sandwiched between two mesh electrodes 122. The operation principle is the same as that of FIG. 12A. The non-motional impedance component appears mainly as an electrostatic capacitance.

In the vibrator drive means for driving the vibrator to cancel a reaction from the resonator, various negative impedance generating means as shown in FIGS. 13 to 21 are used.

Figure 13:
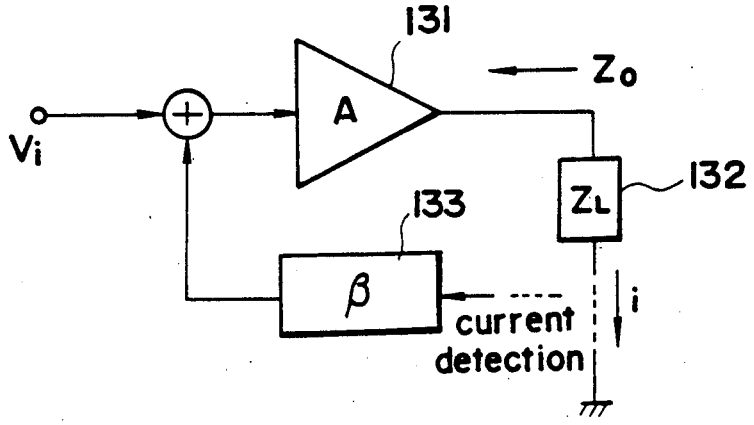
FIG. 13 is a circuit diagram showing a basic arrangement of a circuit for equivalently generating a negative impedance.

FIG. 13 shows the basic arrangement of such a means. As shown in FIG. 13, an output from an amplifier having a gain A is supplied to a load $Z_L$ corresponding to a speaker 132. A current i flowing through the load $Z_L$ is detected, and the detected current is positively fed back to the amplifier 131 through a feedback circuit 133 having a transmission gain $\beta$. With this arrangement an output impedance $Z_0$ of the circuit is calculated as:

$$Z_0=Z_S(1-A\beta) \quad (10)$$

If $A\beta>1$ in equation (10), $Z_0$ becomes an open-circuit stable negative impedance. In equation (10), $Z_S$ is the impedance of a sensor for detecting a current.

Figure 14:
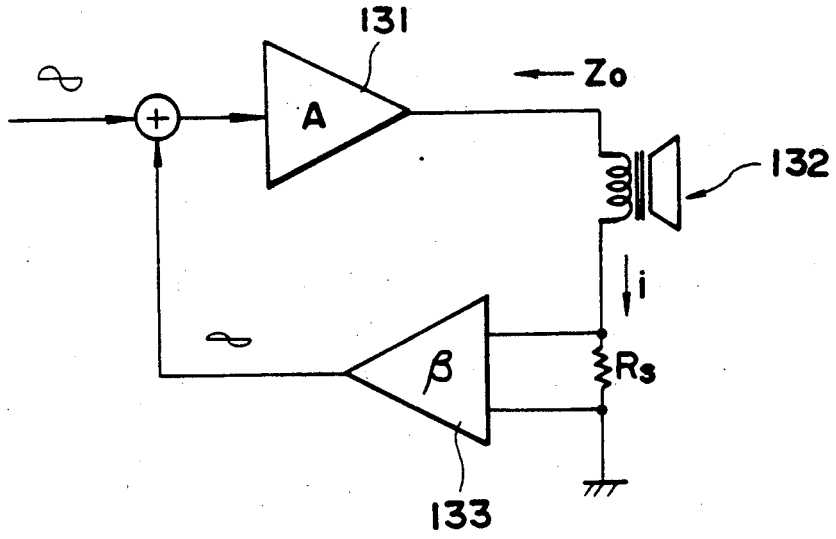
FIGS. 14 to 19 are circuit diagrams of a circuit for generating an equivalent negative resistance.

FIG. 14 shows a circuit wherein the current i is detected by a resistance $R_S$ arranged at a ground side of the speaker 132. With this circuit, from equation (10) above the output impeda $Z_0$ is:

$$Z_0=R_s(1-A\beta)$$

If $A\beta>1$, the output impedance can include an apparent negative resistance component. Note that an embodiment corresponding to such a circuit is disclosed in Japanese Patent Publication No. sho 59-51771.

Figure 15:
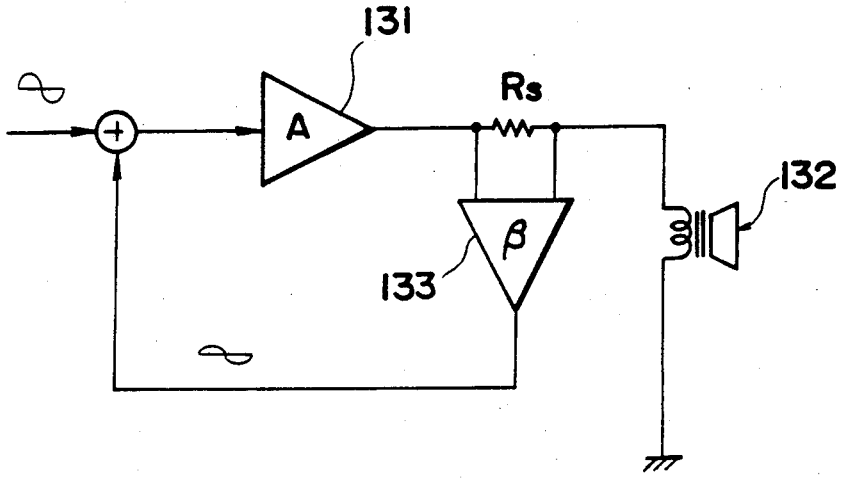
Figure 16:
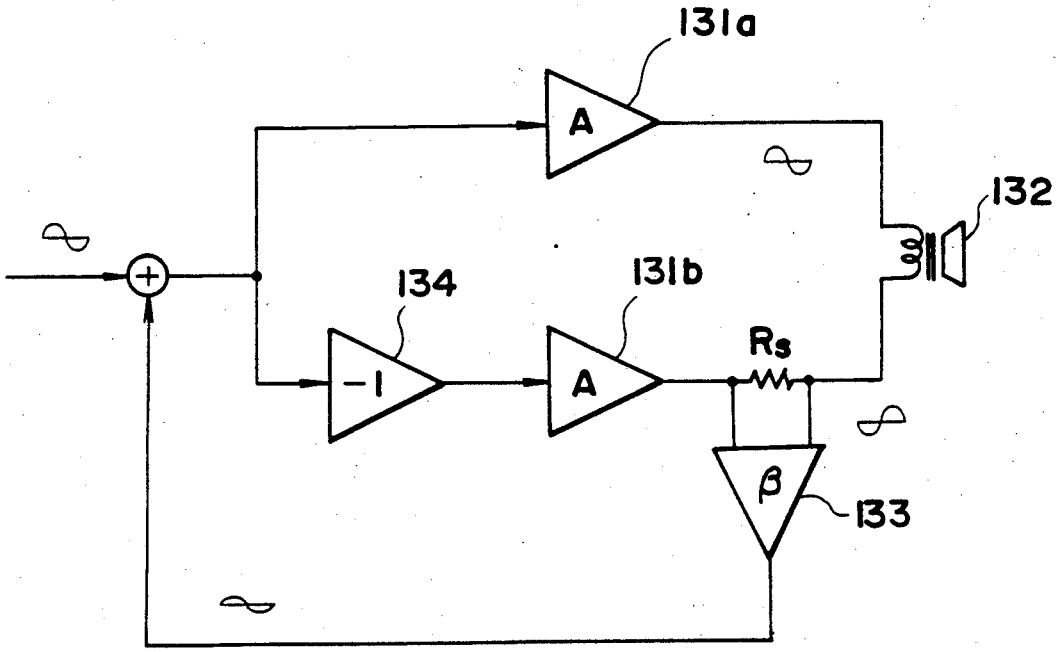

FIG. 15 shows a circuit wherein the current i is detected by a resistance $R_s$ arranged at a non-ground side of the speaker 132. With this circuit, the output impedance $Z_0$ can include a negative resistance component. Note that an embodiment corresponding to such a circuit is disclosed in Japanese Patent Publication No. sho 54-33704. FIG. 16 shows a circuit employing a BTL (balanced transformerless) connection. In FIG. 16, reference numeral 134 denotes an inverter With this circuit the output impedance $Z_0$ is given by:

$$Z_0=R_s(1-A\beta)$$

Figure 17:
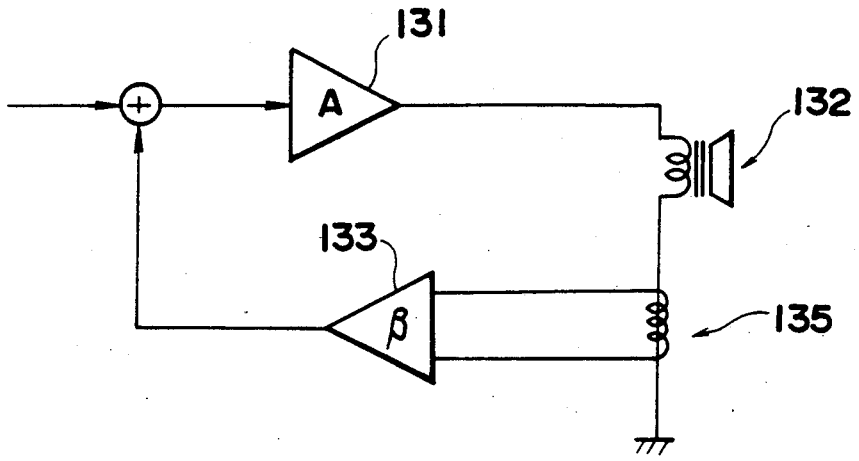

FIG. 17 shows a circuit wherein the current i is detected by a current probe. More specifically, since the current i forms an ambient magnetic field around a connecting line, the magnetic field is detected by a current probe 135, and is fed back to the amplifier 131 through the feedback circuit 133.

Figure 18:
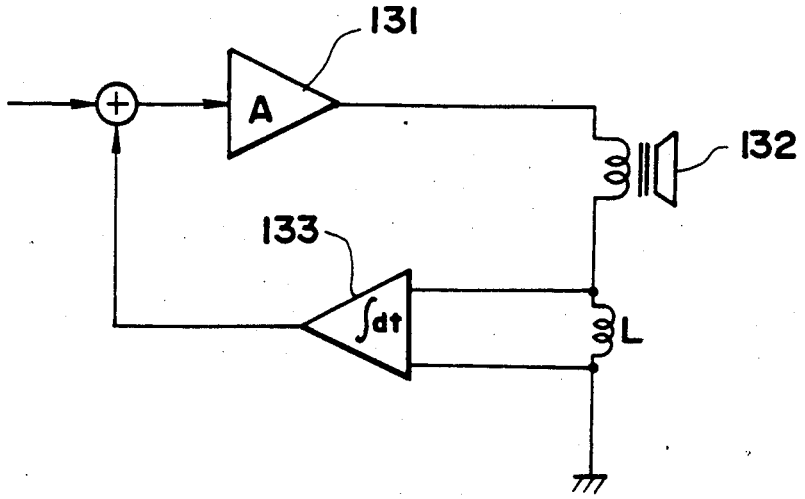

FIG. 18 shows a circuit wherein the feedback circuit 133 employs an integrator More specifically, a voltage across an inductance L is integrated and detected, so that an operation equivalent to resistance detection can be performed. With this circuit, a loss can be reduced near a DC level below that in a case using the resistance $R_s$.

Figure 19:
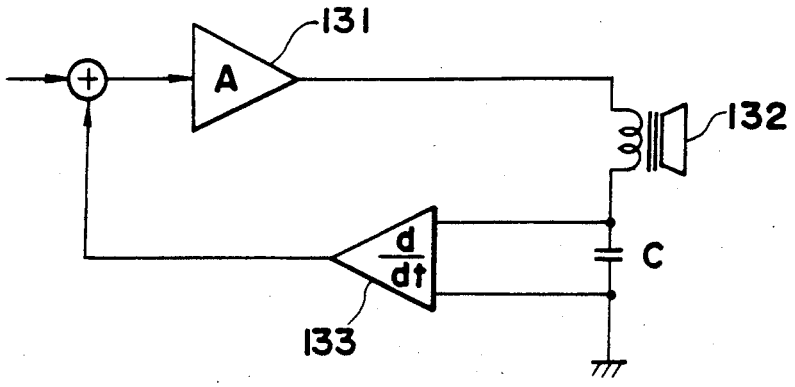

FIG. 19 shows a circuit wherein the feedback circuit 133 employs a differentiator. More specifically, a voltage across a capacitance C is differentiated and detected, so that an operation equivalent to resistance detection can be performed. In this circuit, since the capacitance C is inserted in a drive system of the speaker 132, a DC drive signal component may be cut.

Figure 20:
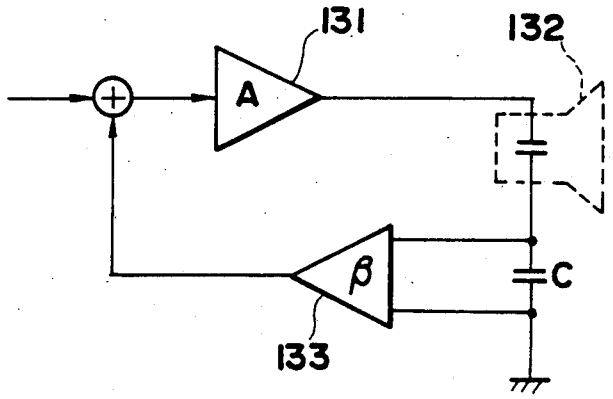
FIG. 20 is a circuit diagram of a circuit for generating an equivalent negative capacitance.

In the above-mentioned circuits, the output impedance $Z_0$ equivalently includes a negative resistance, and the above circuitsare applied when a dynamic or electromagnetic type electro-acoustic transducer is used. In contrast to this, if a piezoelectric or electrostatic type transducer (speaker) is used, the non-motional impedance component corresponds to a capacitance. Therefore, the output impedance $Z_0$ must equivalently include a negative capacitance. FIG. 20 is a circuit diagram of such a circuit. The speaker 132 comprises an electrostatic or piezoelectric speaker. The two ends of the capacitance C at the ground side of the speaker 132 are connected to the feedback circuit 133 With this circuit, from equation (10) above, the output impedance $Z_0$ is given by:

$$Z_0=C(1-A\beta)$$

Figure 21:
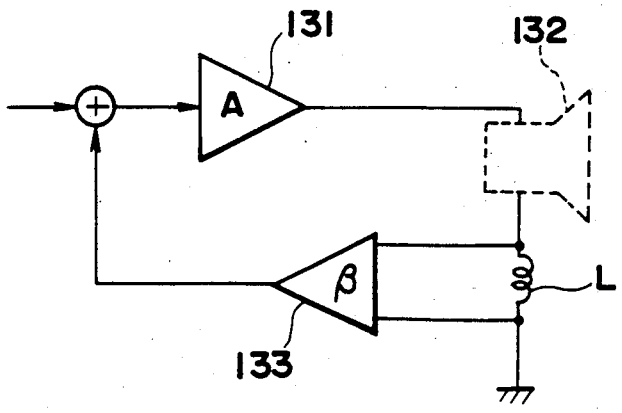
FIG. 21 is a circuit diagram of a circuit for generating an equivalent negative inductance.

When an electro-acoustic transducer which includes an inductance as a non-motional impedance component is used, the output impedance $Z_0$ must include an equivalent negative inductance. Since a dynamic speaker or the like includes some inductance as the non-motional impedance component as well as a resistance, if the inductance component is to be invalidated, the negative inductance must be generated. FIG. 21 is a circuit diagram of such a circuit. As shown in FIG. 21, two ends of an inductance L at the ground side of the speaker 132 are connected to the feedback circuit 133. With this circuit, the output impedance $Z_0$ is given by:

$$Z_0=L(1-A\beta)$$

Embodiments of the present invention will be explained below.

Figure 22:
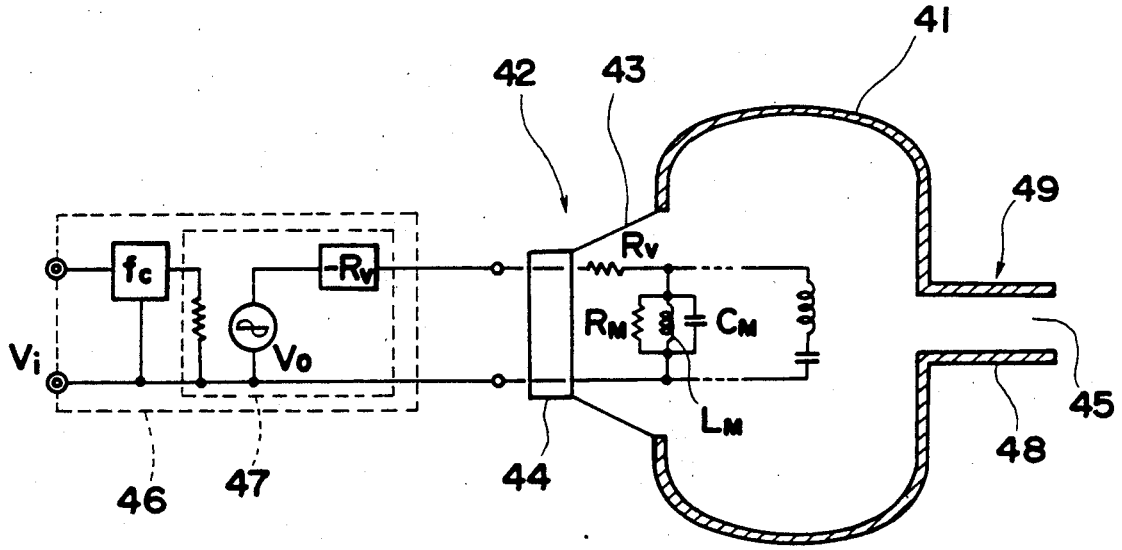
FIG. 22 is a diagram of an acoustic apparatus according to a detailed embodiment.

FIG. 22 is a diagram of an embodiment wherein a dynamic speaker is applied to a cabinet As shown in FIG. 22, a hole is formed in the rear surface (left surface in FIG. 22) of a cabinet 41 as a cavity of the Helmholtz's resonator, and a dynamic speaker 42 is mounted therein. The speaker 42 is constituted by a conical diaphragm 43, and a dynamic transducer 44 arranged near the top of the conical shape of the diaphragm 43. An opening port 45 is formed in a projecting neck 48 on the front surface side (right surface in FIG. 22) of the cabinet 41, and a duct 49 constituted by the opening port 45, the neck 48 etc. forms a resonator as an acoustic radiation member of the present invention. A driver 46 has a servo circuit 47 for negative resistance driving, and the dynamic transducer 44 is driven by the output from the servo circuit 47.

The dynamic transducer 44 has a voice coil DC resistance $R_v$, while the driver 46 has an equivalent negative resistance component ($-R_v$) in the output impedance Therefore, the resistance $R_v$ is essentially invalidated, and the vibrator (speaker 42) is driven to cancel a reaction from the resonator to diaphragm 43. Reference symbols $R_M$, $I_M$, and $C_M$ denote motional impedances obtained when the speaker 42 are electrically equivalently expressed. If the volume of the cabinet 41 is represented by V, the sectional area of the opening port 45 is represented by S, and the neck length of the duct 49 is represented by l, like in equation (1) described above, a resonance frequency $f_{op}$ is given by:

$$f_{op}=c(S/lV)^{1/2}/2\pi$$

Figure 23:
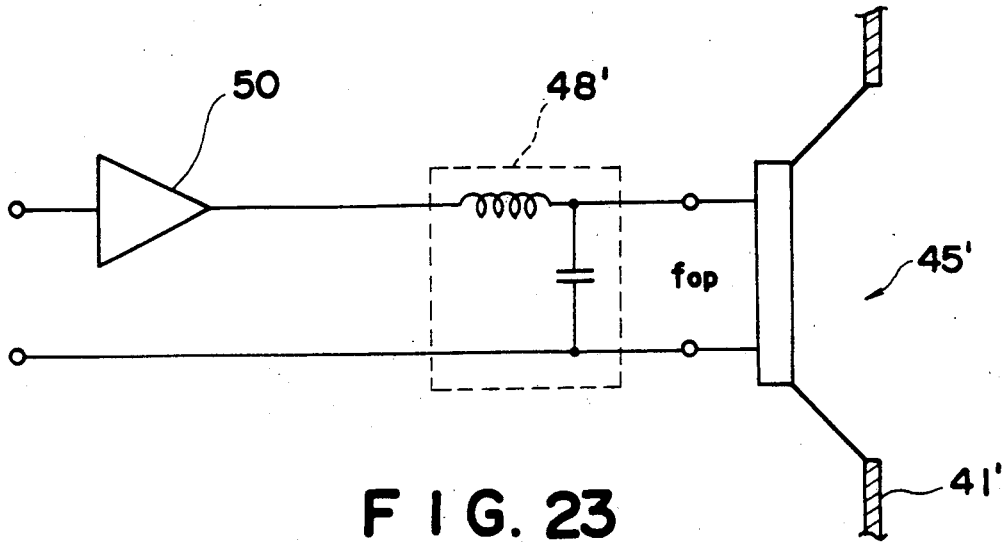
FIG. 23 is a diagram for explaining an arrangement of an equivalent operation of the apparatus shown in Fig.
Figure 24:
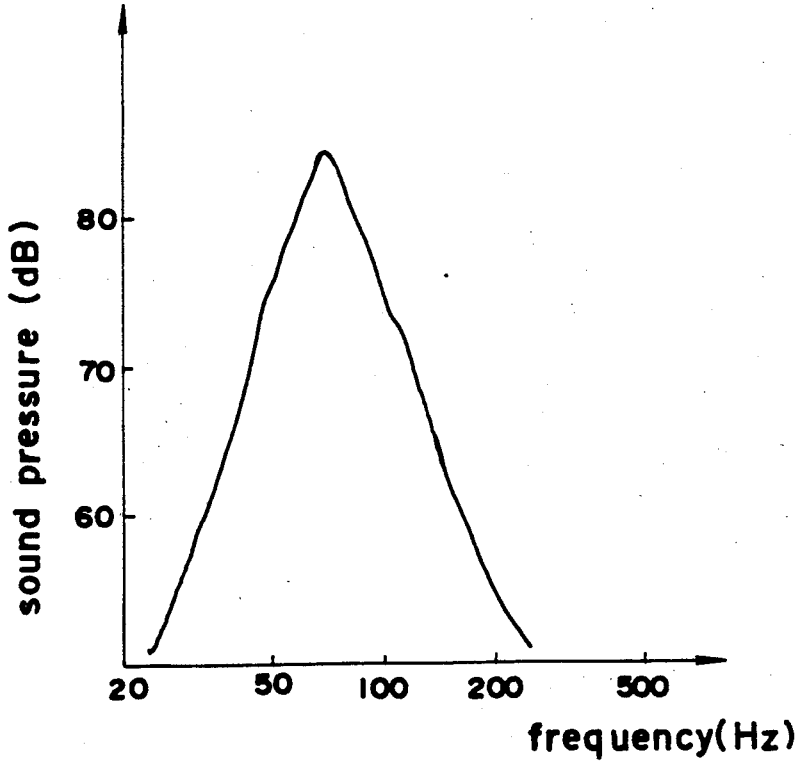
FIG. 24 is a graph showing sound pressure-frequency characteristics according to the embodiment shown in Fig.

The arrangement of the equivalent operation of the embodiment shown in FIG. 22 is as shown in FIG. 23. More specifically, a virtual speaker 45' equivalently formed by the opening port 45 is equivalent to a state wherein it is mounted on a closed cabinet 41' having an infinite volume The speaker 45' is connected to a conventional amplifier 50 (which is not subjected to active servo drive) through an equivalently formed low-pass filter (LPF) 48'. The resonance frequency $f_{op}$ of the virtual speaker 45' is determined by only the opening port 45 and the duct 46, and a resonance Q value can be desirably controlled.

As can be apparent from the above description, according to the embodiment shown in FIGS. 22 and 23, the virtual speaker is equivalently formed by the opening port 45 and the duct 49. Since this arrangement is equivalent to a state wherein the speaker is mounted on a closed cabinet having an infinite volume, extremely excellent bass reproduction characteristics can be realized. The specifications of the speaker unit and the cabinet can be desirably designed without restricting each other, and the cabinet can be rendered compact without posing a problem. The resonance frequency of the resonator formed by the cabinet and the duct can be set regardless of the volume of the cabinet, and the system can be rendered compact as compared with any conventional speaker systems. More specifically, when the volume of the Helmholtz's resonance cabinet was set to be 3.5, excellent sound pressure-frequency characteristics illustrated in FIG. 24 could be obtained.

The virtual speaker is equivalently connected to the amplifier 50 through the equivalent filter 48' shown in FIG. 23 in view of a deviation velocity of its virtual diaphragm.

A range where a reproduction sound pressure is insufficient can be easily controlled by increasing/decreasing an input signal level according to the signal frequency by the amplifier.

Figure 25:
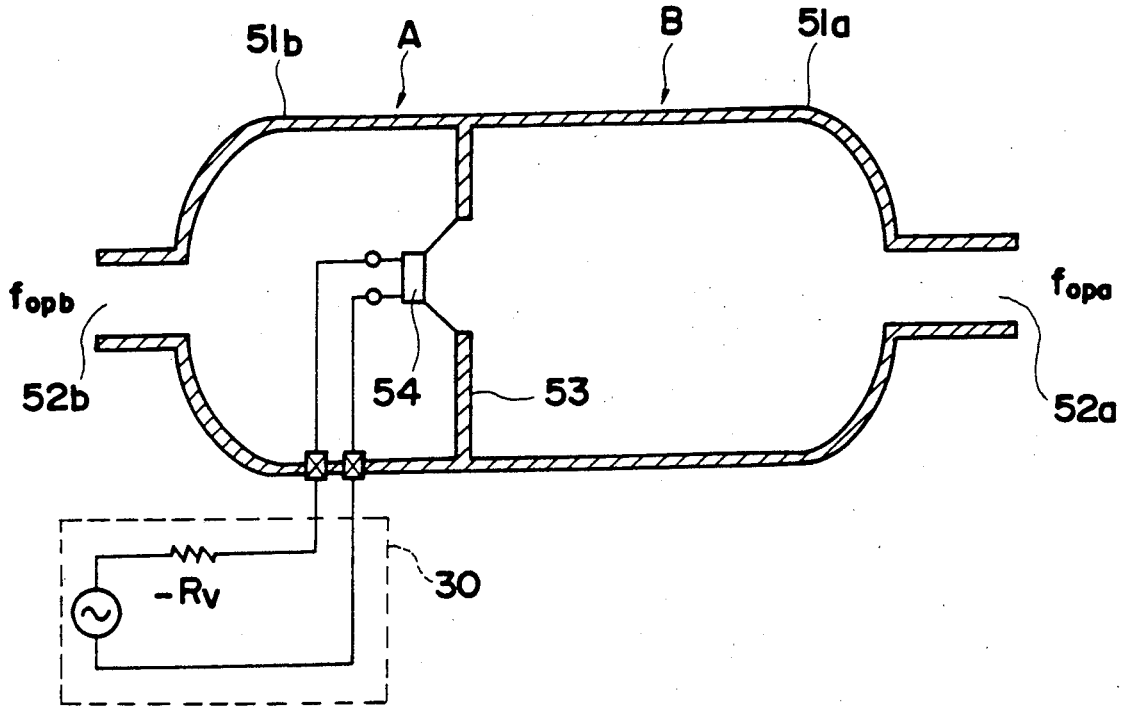
FIG. 25 is a diagram showing an acoustic apparatus according to another embodiment of the present invention.

FIG. 25 shows another embodiment of the present invention. As shown in FIG. 25, a Helmholtz's resonator comprises first and second resonators 51*a* and 51*b*, which have opening ports 52*a* and 52*b*, respectively. A hole is formed in a partition wall 53 between the resonators 51*a* and 52*b*, and a dynamic speaker 54 is mounted therein. The speaker 54 is driven by a drive controller 30 equivalently having a negative output impedance ($-R_v$) and is not influenced by reactions from the first and second resonators 51*a* and 51*b*, and its diaphragm becomes part of wall surfaces of these resonators. In this case, Helmholtz's resonance systems A and B have independent resonance frequencies $f_{opa}$ and $f_{opb}$, respectively.

Some prototypes designed by the present inventors will be explained below.

Figure 26:
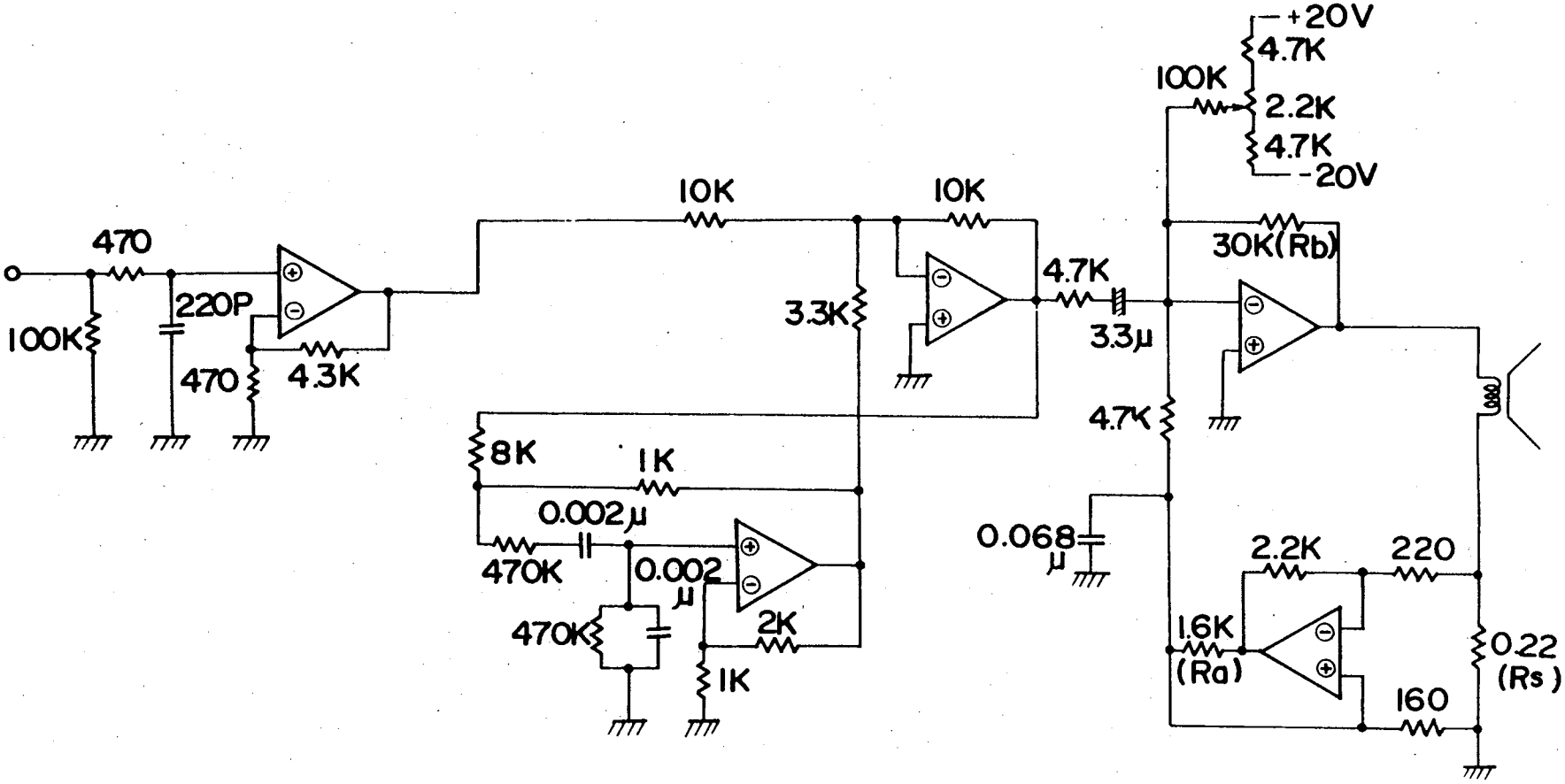
FIG. 26 is a circuit diagram when a virtual speaker system is equivalently realized using one vibrator.

FIG. 26 is a circuit diagram of a driver used when a virtual speaker system is equivalently constituted using a single dynamic cone speaker. In FIG. 26, the negative output impedance $Z_0$ is given by:

$$\begin{aligned} Z_0 &= R_s(1 - R_b/R_a) \\ &= 0.22(1 - 30/1.6) \\ &= -3.9\ (\Omega) \end{aligned}$$

Figure 27:
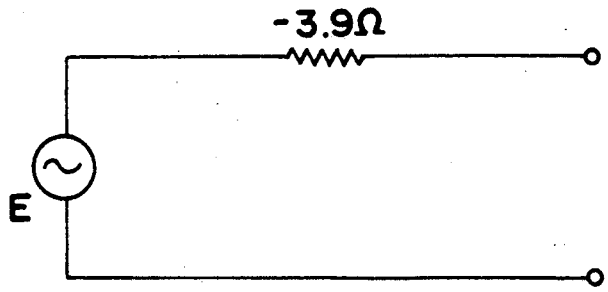
FIG. 27 is a diagram for explaining an output impedance equivalently formed in FIG. 26.

More specifically, in the circuit shown in FIG. 26, the equivalent output impedance is as shown in FIG. 27.

Figure 28:
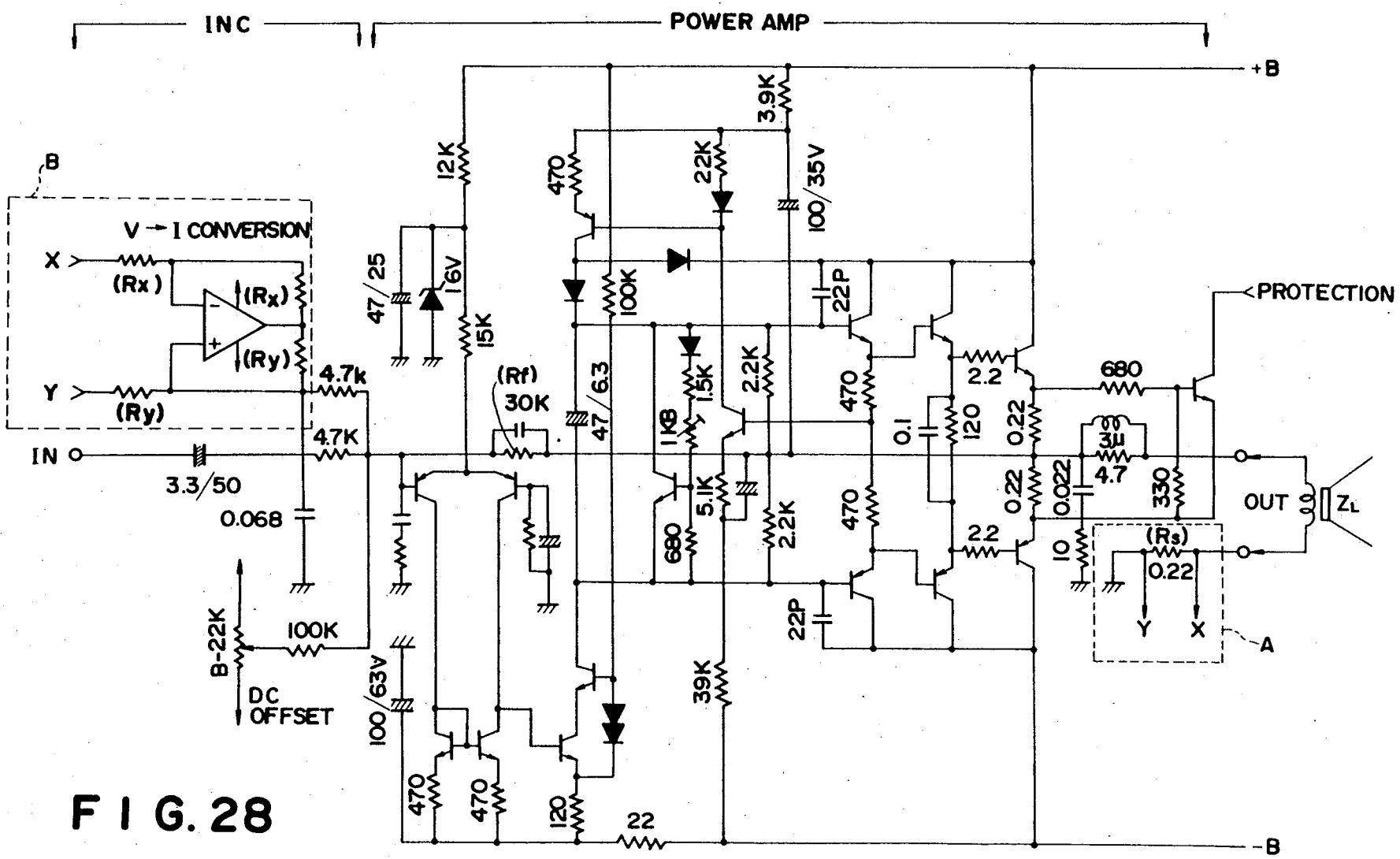
FIG. 28 is a circuit diagram of a negative resistance power amplifier of a low distortion factor.

FIG. 28 is a circuit diagram of a negative resistance power amplifier with a low distortion factor. In FIG. 28, an A portion enclosed by a dotted line corresponds to the detection resistance $R_s$ shown in FIGS. 14 and 26, and a B portion enclosed by a dotted line corresponds to a portion for reconverting a voltage corresponding to a detected current value into a current and feeding back the current to an input side, and corresponds to the circuit 133 in FIG. 14. Voltage-current conversion is performed to prevent an influence of a ground potential difference between the detection section and the input feedback section. In this circuit, the output impedance $Z_0$ is given by:

$$Z_O = R_s(1 - R_f/R_y)$$

Therefore, since $R_f = 30\ k\Omega$, when $R_y < 30k\Omega$, the output impedance $Z_0$ can include an equivalent negative resistance component.

The present inventors obtained the following results upon comparison between the effect of the acoustic apparatus according to present invention and the effect of the conventional apparatus.

In an acoustic apparatus according to the present invention, the volume of the cavity of the Helmholtz's resonator was 6l, the inner diameter of the opening port was 3.3 cm, and its neck length was 25 cm. When a negative resistance drive operation was performed with a dynamic cone speaker, bass reproduction to $f_{op} = 41$ Hz could be achieved. In contrast to this, in the conventional apparatus which does not perform a negative resistance drive, when a dynamic cone speaker having $f_o = 50$ Hz, $Q = 0.5$, and a diameter $= 20$cm was used, bass reproduction to $f_{op} = 41$ Hz was achieved when the volume of the cabinet was 176l. Therefore, it was found that the volume of the cabinet could be reduced to about 1/30 at an identical bass reproduction level according to the present invention.

EFFECT OF THE INVENTION

As has been described above in detail, according to the present invention, a diaphragm equivalently becomes a wall of a resonator, and an internal impedance of a vibrator does not cause a decrease in resonance Q value. For this reason, the resonance Q value can be extremely increased. The resonator and the vibrator are present independently of each other, and the resonance frequency of the resonator can be set regardless of the volume of the resonator. Therefore, the resonator can be readily rendered compact When the resonator is rendered compact and the resonance frequency is decreased, in the conventional devices, the acoustic resistance of the resonator is increased. However, according to the present invention, even in a case wherein the resonance Q value is much decreased in a conventional drive method, the resonance Q value is not decreased by the vibrator. As a result, the resonance Q value can be maintained at a sufficiently high value, and sufficient acoustic radiation power of the resonator can be kept.

As described above, improvement of radiation power of a resonance acoustic wave and a compact resonator can be simultaneously achieved.

The acoustic apparatus of the present invention can be widely applied to sound sources of electronic or electric musical instruments, and the like as well as audio speaker systems.

What is claimed is:

1. An acoustic apparatus comprising:

a resonator having a resonance radiation unit for radiating an acoustic wave by resonance;

a vibrator having a diaphragm constituting a part of said resonator and disposed in said resonator; and a vibrator drive means for driving said vibrator so as to drive the resonator and to substantially cancel counterreaction of the resonator upon the vibration action of the diaphragm caused in response to driving of said resonator, wherein the resonator has a resonance frequency and resonance Q value set at desired values independent of the influence of the vibrator.

2. An apparatus according to claim 1 wherein said resonator comprises a Helmholtz's resonator having an opening.

3. An apparatus according to claim 2, wherein said opening has a cylindrical neck.

4. An apparatus according to claim 1, wherein said vibrator comprises a dynamic electro-acoustic transducer.

5. An apparatus according to claim 1, wherein said vibrator comprises an electromagnetic electro-acoustic transducer.

6. An apparatus according to claim 1, wherein said vibrator comprises an electrostatic electro-acoustic transducer.

7. An apparatus according to claim 1, wherein said vibrator comprises a piezoelectric electro-acoustic transducer.

8. An apparatus according to claim 1, wherein said vibrator drive means comprises negative impedance generating means for equivalently generating a negative impedance component in an output impedance.

9. An apparatus according to claim 8, wherein said negative impedance generating means is arranged to positively feed back a signal corresponding to a drive current of said vibrator to an input side of said vibrator drive means, thereby equivalently generating the negative impedance component.

10. An apparatus according to claim 9, wherein said negative impedance generating means is arranged to equivalently generate the negative resistance component in an output impedance.

11. An acoustic apparatus according to claim 1 wherein the resonator includes an enclosure having an internal volume V, a duct having a sectional area S and a length l, the duct having a port from which an acoustic wave is radiated, wherein V, S and l are set at desired values to achieve a resonance frequency $f_{op}$ in accordance with the relationship:

$$f_{op} = c(S/Vl)^{\frac{1}{2}}/2\pi$$

where c is the velocity of sound.

12. An acoustic apparatus according to claim 11 wherein the duct has its length l determined in accordance with the desired Q value of the resonator.

13. An acoustic apparatus according to claim 11 wherein the duct is cylindrical.

14. An acoustic apparatus as in claim 1 further including a second resonator having a second radiation unit for radiating an acoustic wave by resonance and also driven by said diphragm, wherein the vibrator is entirely enclosed by the resonators and there is no direct acoustic radiation from the vibrator.

15. An acoustic apparatus as in claim 1 wherein the resonator includes an enclosure having a radiation port on a first side thereof from which an acoustic wave is radiated and an opening on a second side thereof other than the first side, wherein the vibrator is disposed in the opening.

16. An acoustic apparatus according to claim 15 wherein the second side is opposite the first side.

17. An acoustic apparatus as in claim 1 further comprising a cabinet including a first cavity forming a portion of the resonator and a second cavity adjacent the first cavity, wherein the vibrator is located between the first and second cavities.

18. An acoustic apparatus as in claim 17 further including a second resonator including the second cavity as a portion thereof, wherein the second resonator is also driven by the vibrator, said resonators having different resonance frequencies.

* * * * *